US011525336B2

(12) United States Patent
Zhu

(10) Patent No.: US 11,525,336 B2
(45) Date of Patent: Dec. 13, 2022

(54) PRODUCTION NOZZLE FOR SOLVENT-ASSISTED RECOVERY

(71) Applicant: Variperm Energy Services Inc., Calgary (CA)

(72) Inventor: Da Zhu, Calgary (CA)

(73) Assignee: VARIPERM ENERGY SERVICES INC., Calgary (CA)

( * ) Notice: Subject to any disclaimer, the term of this patent is extended or adjusted under 35 U.S.C. 154(b) by 0 days.

(21) Appl. No.: 17/156,439

(22) Filed: Jan. 22, 2021

(65) Prior Publication Data

US 2021/0230979 A1 Jul. 29, 2021

Related U.S. Application Data

(60) Provisional application No. 62/965,588, filed on Jan. 24, 2020.

(51) Int. Cl.

| | |
|---|---|
| ***E21B 41/00*** | (2006.01) |
| ***E21B 43/241*** | (2006.01) |
| ***E21B 43/12*** | (2006.01) |
| ***E21B 43/29*** | (2006.01) |
| *E21B 43/24* | (2006.01) |

(52) U.S. Cl.
CPC ..... *E21B 41/0078* (2013.01); *E21B 43/12* (2013.01); *E21B 43/241* (2013.01); *E21B 43/29* (2013.01); *E21B 43/2408* (2013.01)

(58) Field of Classification Search
CPC ..... E21B 43/24; E21B 43/20; E21B 43/12; E21B 43/08; E21B 43/29; E21B 43/14; E21B 7/18; E21B 10/60; E21B 41/0078
See application file for complete search history.

(56) References Cited

U.S. PATENT DOCUMENTS

| | | | |
|---|---|---|---|
| 4,648,455 | A | 3/1987 | Luke |
| 5,092,159 | A | 3/1992 | Chien |
| 5,141,055 | A | 8/1992 | Chien et al. |
| 6,524,368 | B2 | 2/2003 | Betting et al. |
| 6,708,763 | B2 | 3/2004 | Howard et al. |
| 7,419,002 | B2 | 9/2008 | Dybevik et al. |
| 7,537,056 | B2 | 5/2009 | MacDougall |

(Continued)

FOREIGN PATENT DOCUMENTS

| | | | |
|---|---|---|---|
| CA | 2622939 | A1 | 10/2008 |
| CA | 2679148 | A1 | 3/2010 |

(Continued)

OTHER PUBLICATIONS

International Search Report and Written Opinion received for PCT serial No. PCT/CA2019/050636 dated Jul. 17, 2019, 9 pages.

(Continued)

*Primary Examiner* — Yong-Suk (Philip) Ro
(74) *Attorney, Agent, or Firm* — Dykema Gossett PLLC

(57) ABSTRACT

A nozzle for mitigating against solvent flashing in a solvent-assisted hydrocarbon extraction process comprises a fluid passage extending between an inlet and an outlet, wherein the fluid passage comprises a converging region, a throat, and a diverging region, and wherein at least the converging region is provided with a gradually reducing internal diameter. Preferably, the angle of convergence of the converging region is equal to or less than about 5 degrees.

13 Claims, 7 Drawing Sheets

(56) References Cited

U.S. PATENT DOCUMENTS

| | | | | |
|---|---|---|---|---|
| 8,474,535 | B2 | 7/2013 | Richards et al. | |
| 8,496,059 | B2 | 7/2013 | Schultz et al. | |
| 8,689,883 | B2 | 4/2014 | Kim | |
| 9,027,642 | B2 | 5/2015 | Sladic et al. | |
| 9,249,649 | B2 | 2/2016 | Fripp et al. | |
| 9,518,455 | B2 | 12/2016 | Franklin et al. | |
| 9,631,461 | B2 | 4/2017 | Lopez et al. | |
| 9,638,000 | B2 | 5/2017 | Dyck | |
| 2002/0162589 | A1 | 11/2002 | Lorch et al. | |
| 2006/0048942 | A1 | 3/2006 | Moen et al. | |
| 2006/0118296 | A1 | 6/2006 | Dybevik et al. | |
| 2008/0041588 | A1 | 2/2008 | Richards et al. | |
| 2008/0283238 | A1 | 11/2008 | Richards et al. | |
| 2011/0198097 | A1 | 8/2011 | Moen | |
| 2012/0006563 | A1 | 1/2012 | Patel et al. | |
| 2014/0319970 | A1* | 10/2014 | Sherrit | H02N 2/185 310/339 |
| 2015/0292300 | A1 | 10/2015 | Franklin et al. | |
| 2016/0010425 | A1 | 1/2016 | Dyck | |
| 2016/0160616 | A1 | 6/2016 | Moen et al. | |
| 2017/0044868 | A1 | 2/2017 | van Petegem et al. | |
| 2017/0058655 | A1 | 3/2017 | Lastiwka | |
| 2018/0030812 | A1 | 2/2018 | Ning et al. | |
| 2018/0045027 | A1 | 2/2018 | Haley et al. | |

FOREIGN PATENT DOCUMENTS

| | | | |
|---|---|---|---|
| CA | 2934369 | A1 | 6/2015 |
| CA | 2887860 | C | 1/2017 |
| CA | 2862161 | C | 5/2017 |
| CA | 2862111 | C | 8/2017 |
| CA | 2959880 | A1 | 9/2017 |
| CA | 2917392 | C | 1/2018 |
| CA | 2871354 | E | 6/2019 |
| WO | 2019/090425 | A1 | 5/2019 |
| WO | 2020/069614 | A1 | 4/2020 |

OTHER PUBLICATIONS

International Search Report and Written Opinion received for PCT serial No. PCT/CA2019/050942 dated Sep. 17, 2019, 8 pages.
International Search Report and Written Opinion received for PCT serial No. PCT/CA2019/051407 dated Dec. 12, 2019, 6 pages.

* cited by examiner

PRODUCTION NOZZLE FOR SOLVENT-ASSISTED RECOVERY

CROSS REFERENCE TO PRIOR APPLICATION

The present application claims priority under 35 U.S.C. 119 to U.S. Application No. 62/965,588, filed Jan. 24, 2020, the entire contents of which are incorporated herein by reference.

FIELD OF THE DESCRIPTION

The present description relates to a nozzles, or flow control device, used for controlling flow of fluids into a tubular member, such as during the production phase of a hydrocarbon extraction process. In a particular aspect, the nozzle is adapted for use on tubular members used for producing hydrocarbons from subterranean reservoirs. More particularly, the described nozzle aids in retaining solvents used for production in a liquid state.

BACKGROUND

Subterranean hydrocarbon reservoirs are generally accessed by one or more wells that are drilled into the reservoir to access the hydrocarbon materials. Such materials (which may be referred to simply "hydrocarbons") are then pumped to the surface through production tubing. The wells drilled into the reservoirs may be vertical or horizontal or at any angle there-between.

In conventional hydrocarbon production methods, the wells are drilled into a hydrocarbon containing reservoir and the hydrocarbon materials are brought to surface using, for example, pumps etc. In some cases, such as where the hydrocarbons comprise a highly viscous material, such as heavy oil and the like, enhanced oil recovery, or "stimulation", methods may be used. Steam Assisted Gravity Drainage, "SAGD" and Cyclic Steam Stimulation, "CSS", are examples of these methods. Such methods serve to increase the mobility of the desired hydrocarbons and thereby facilitate the production thereof. In a SAGD operation, a number of well pairs, each typically comprising a horizontal well, are drilled into a reservoir. Each of the well pairs comprises a steam injection well and a production well, with the steam injection well being positioned generally vertically above the production well. In operation, steam is injected into the injection well and the heat from such steam is allowed to permeate into the surrounding formation and thereby reduce the viscosity of hydrocarbon material, typically heavy oil, in the vicinity of the injection well. After steam treatment, the hydrocarbon material, now mobilized, drains into the lower production well by gravity, and is subsequently brought to the surface through the production tubing. In a CSS process, a single well may be used to first inject steam into the reservoir through tubing, generally production tubing. After the steam injection stage, the heat from the steam is allowed to be absorbed into the reservoir, a stage referred to as "shut in" or "soaking", during which the viscosity of the neighbouring hydrocarbon material is reduced thereby rendering such material more mobile. Following the shut in stage, the hydrocarbons are produced through the well in a production stage.

Tubing used in wellbores typically comprises a number of segments, or tubulars, that are connected together. Various tools (such as packers, sleeves, downhole telemetry devices etc.) may also be provided at one or more positions along the length of the tubing and connected inline with adjacent tubulars. The tubing, for either steam injection and/or hydrocarbon production, generally includes a number of apertures, or ports, along its length. The ports provide a means for injection of steam and/or other viscosity reducing agents, and/or for the inflow of hydrocarbon materials from the reservoir into the pipe and thus into the production tubing. The segments of tubing having ports are also often provided with one or more filtering devices, such as sand screens, which serve to prevent or mitigate against sand and other solid debris in the well from entering the tubing.

It is also common to incorporate nozzles, or flow control devices, for controlling the flow of fluids into (e.g. for production) or out of (e.g. for steam injection etc.) the ports. For example, inflow control devices, or ICDs, are provided in combination with sand screens and are positioned adjacent ports on the tubing. In this way, the ICDs control the flow of fluids entering the tubing after being filtered to remove particles and other debris. Various ICDs have been proposed for the purpose of limiting or choking the flow of steam and/or non-condensable gas (NCG). In such cases, the ICDs are provided with internal profiles specifically designed for the given purpose (e.g. steam or NCG choking, etc.) Examples of known ICDs designed for restricting undesired production of NCG and like components are provided in US 2017/0044868; U.S. Pat. No. 7,537,056; US 2008/0041588; and, U.S. Pat. No. 8,474,535. Many of these ICDs involve the use of moving elements to dynamically adjust to local fluid compositions and are therefore relatively complicated. Other ICDs are primarily concerned with choking of gas contained in the reservoir, so as to preferentially produce heavier hydrocarbon components. An example of such nozzle is provided in the Applicant's PCT Application No. PCT/CA2019/051407, the entire contents of which are incorporated herein by reference.

In addition to, and/or in combination with, the hydrocarbon production methods as discussed above, e.g. SAGD, CSS, it is also common to improve the production of heavy hydrocarbon materials (generally referred to herein as "oil") by injecting one or more solvents into the reservoir to increase the mobility of the desired materials. These methods are often referred to as solvent-assisted or solvent-based recovery methods. The solvents typically comprise light, or low molecular weight hydrocarbon materials, such as for example C3 to C12 hydrocarbons. These solvents are injected into the reservoir, often in combination with steam (such as for SAGD or CSS), and are allowed to mix with the heavy oil in the reservoir. The resulting decrease in viscosity of the mixture improves flowability of the oil and therefore improves production efficiency.

When using solvents, one problem that is encountered is the flashing of the liquid solvent during the production phase. More specifically, within the reservoir, which is at a higher pressure, the injected solvent is present in liquid form; however, during production, as the solvent passes through the ports in the production tubing, the pressure drop across the port, or, if present the nozzle, results in flashing of the liquid solvent into its vapour form. This has two consequences. First, due to its higher mobility, the solvent vapour is preferentially produced over the desired oil, thereby reducing production efficiency. Second, once flashed, recovery of the solvent component is difficult, thereby resulting increased solvent cost.

There exists a need for an improved nozzle, or ICD, that prevents the flashing of solvent during production of oil from a reservoir.

SUMMARY OF THE DESCRIPTION

In one aspect, there is provided an inflow control nozzle for maintaining solvent in liquid form during production of hydrocarbons into a pipe, the pipe having at least one port along its length, the nozzle being adapted to be located on the exterior of the pipe and adjacent one of the at least one port, the nozzle comprising first and second openings and a fluid passage extending there-between, and wherein the fluid passage includes converging and diverging sections.

In one aspect, there is provided an inflow control nozzle for maintaining solvent in liquid form during production of hydrocarbons into a pipe, the pipe having at least one port along its length, the nozzle being adapted to be located on the exterior of the pipe and adjacent one of the at least one port, the nozzle comprising:

a body having an inlet, an outlet, and a fluid conveying passage therebetween, the passage having a longitudinal axis extending in a direction from the inlet to the outlet;

wherein, the passage comprises:

a converging region for receiving fluids from the inlet, the converging region comprising a gradually reducing cross-sectional area along the axis;

the converging region terminating at a throat defining a region of minimal cross-sectional area along the axis; and, a diverging region, for conveying fluids from the throat to the outlet, the diverging region comprising a gradually increasing cross-sectional area along the axis.

In one aspect, the throat of the nozzle is located closer to the inlet.

In another aspect, there is provided an apparatus for maintaining solvent in liquid form during production of hydrocarbons into a pipe, the apparatus comprising: a pipe segment having at least one port along its length; at least one inflow control nozzle located on the exterior of the pipe and adjacent one of the at least one port; and, a means for locating the nozzle on the pipe adjacent the port; wherein the nozzle comprises:

a body having an inlet, an outlet, and a fluid conveying passage therebetween, the passage having a longitudinal axis extending in a direction from the inlet to the outlet;

wherein, the passage comprises:

a converging region for receiving fluids from the inlet, the converging region comprising a gradually reducing cross-sectional area along the axis;

the converging region terminating at a throat defining a region of minimal cross-sectional area along the axis; and, a diverging region, for conveying fluids from the throat to the outlet, the diverging region comprising a gradually increasing cross-sectional area along the axis.

In another aspect, there is provided a method of producing fluids from a subterranean reservoir while limiting the flashing of at least one solvent present in the reservoir, the method comprising:

a) providing a nozzle adjacent a port on a section of production tubing for use in producing hydrocarbons from the reservoir, the nozzle having an inlet for receiving fluids from the reservoir and an outlet for conveying the fluids into the production tubing, the nozzle further having a passageway with a converging region having a gradually reducing cross-sectional area for receiving fluids from the inlet, a throat defining a region of minimal cross-sectional area, and a diverging region of gradually increasing cross-sectional area for providing fluids to the outlet;

b) flowing the fluids through the converging region, through the throat, and through the diverging region without flashing the at least solvent.

BRIEF DESCRIPTION OF THE FIGURES

The features of certain embodiments will become more apparent in the following detailed description in which reference is made to the appended figures wherein.

Figure 1:
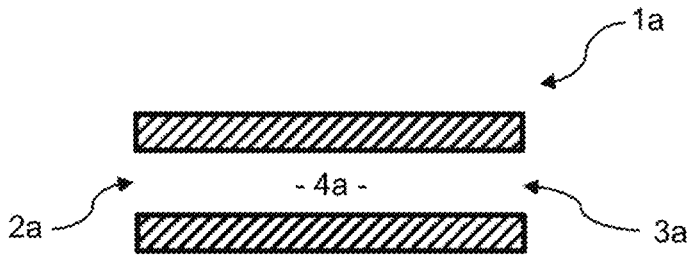
Fig. 1 (Prior Art)
FIG. 1 is a side cross-sectional view of a flow control nozzle as known in the art.

It will be understood that FIGS. 1 to 6, in particular, are merely intended to illustrate the features shown and are not drawn to scale. The present description is not limited to size or scale of the depictions illustrated in these figures.

DETAILED DESCRIPTION

As used herein, the terms "nozzle", "nozzle insert", or "flow control device" will be understood to mean a device that controls the flow of a fluid flowing there-through. In one example, the nozzle described herein serves to control the flow of a fluid through a port in a pipe in at least one direction. More particularly, the nozzle described herein comprises an inflow control device, or ICD, for controlling the flow of fluids into a pipe through a port provided on the pipe wall.

The terms "regulate", "limit", "throttle", and "choke" may be used herein. It will be understood that these terms are intended to describe an adjustment of the flow of a fluid passing through the nozzle described herein. The present nozzle is designed to allow the flow of a volatile material, such as a solvent for heavy oil recovery, while avoiding or limiting the degree to which solve volatile material is flashed as it passes through the nozzle.

The term "hydrocarbons" refers to hydrocarbon compounds that are found in subterranean reservoirs. Examples of hydrocarbons include oil and gas. For the purposes of the present description, the desired hydrocarbon component is primarily oil, such as heavy oil.

The term "solvent" refers to solvents that injected into hydrocarbon-containing reservoirs to improve the production of such hydrocarbons. The solvent for the present description may be any solvent known in the art for hydrocarbon recovery. Typically, such solvents are light hydrocarbon materials, comprising, for example, one or more C3 to C12 compounds.

The term "wellbore" refers to a bore drilled into a subterranean formation, such as a formation containing hydrocarbons.

The term "wellbore fluids" refers to hydrocarbons and other materials contained in a reservoir that are capable of entering into a wellbore. The present description is not limited to any particular wellbore fluid(s).

The terms "pipe" or "base pipe" refer to a section of pipe, or other such tubular member. The base pipe is generally provided with one or more ports or slots along its length to allow for flow of fluids there-through.

The term "production" refers to the process of producing wellbore fluids, in particular, the process of conveying wellbore fluids from a reservoir to the surface.

The term "production tubing" refers to a series of pipe segments, or tubulars, connected together and extending through a wellbore from the surface into the reservoir.

The terms "screen", "sand screen", "wire screen", or "wire-wrap screen", as used herein, refer to known filtering or screening devices that are used to inhibit or prevent sand or other solid material from the reservoir from flowing into the pipe. Such screens may include wire wrap screens, precision punched screens, premium screens or any other screen that is provided on a base pipe to filter fluids and create an annular flow channel. The present description is not limited to any particular screen described herein.

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other features, integers, steps, components or a group thereof, as would be apparent to persons skilled in the relevant art.

In the present description, the terms "top", "bottom", "front" and "rear" may be used. It will be understood that the use of such terms is purely for the purpose of facilitating the description of the embodiments described herein. These terms are not intended to limit the orientation or placement of the described elements or structures in any way.

FIG. 1 illustrates a commonly known nozzle often used for solvent-assisted oil extraction. As will be understood, the nozzle 1*a* has a generally tubular shape with a generally circular inlet 2*a* and a generally circular outlet 3*a* and a passage 4*a* extending therebetween. The passage 4*a* includes a generally constant cross-sectional area along its length. Nozzles such as shown at 1*a* are generally arranged on a pipe in a manner similar to that shown in FIG. 4 described further below. One of the issues associated with nozzles such as that illustrated in FIG. 1 is that the immediate reduction in flow area posed by the inlet results in the formation of a vena contracta downstream of the inlet and, consequently, turbulence and a rapid increase in flow velocity, thereby resulting in a larger pressure drop in the fluid. This pressure drop results in the flashing of solvent and formation of a solvent vapour phase. This effect is similar to that encountered when fluid flows through an orifice. Although pressure recovery may be achieved downstream of the vena contracta along the length of the nozzle 1*a*, it would generally be insufficient to return the flashed solvent to the liquid state.

Figure 2:
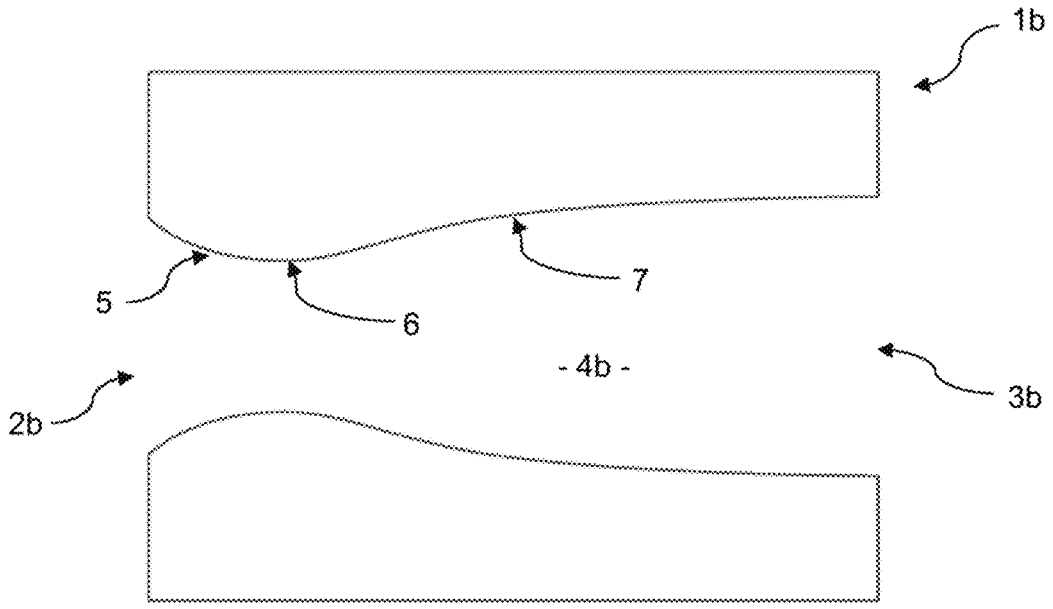
FIG. 2 is a side cross-sectional view of another flow control nozzle designed for gas choking.

Another nozzle, or inflow control device, ICD, is illustrated in FIG. 2. This Figure illustrates an exemplary ICD for choking the production of gas from a reservoir, and is described in applicant's PCT Application No. PCT/CA2019/051407. This nozzle, shown at 1*b*, also includes an inlet 2*b*, an outlet 3*b* and a passage 4*b* extending there-between. In this case, the passage 4*a* is provided with a converging region 5, comprising a reducing cross-sectional area of the passage 4*a* in a direction from the inlet to the outlet. The converging region 5 is positioned proximal to the inlet and has a gradual but noticeable reduction in cross-sectional area. A throat 6 comprises the portion of the passage 4*a* having the minimal, or smallest, cross-sectional area in the passage 4*a*. Following the throat 6, the passage 4*a* of the nozzle 1*a* includes a diverging region 7 comprising a region of gradual increase in the cross-sectional area along the passage 4*a* until the outlet 3*b* is reached. As discussed in PCT/CA2019/051407, the nozzle shown in FIG. 2 is particularly suite for choking gas during the hydrocarbon production phase. Although offering various advantages relating to gas choking, the nozzle 1*b* of FIG. 2 is not completely effective in avoiding solvent flashing owing to the pressure drop in the fluid flowing past the throat.

The present inventor has found that the nozzles shown in FIGS. 1 and 2, while having certain advantages in specific production applications, are not well suited for solvent-assisted production operations as such nozzles are not efficient in limiting the flashing of the solvent component.

In general, the present description relates to a flow control device, or nozzle, that serves to control or regulate the flow of fluids between a reservoir and a base pipe, or section of production tubing. As discussed above, one of the problems encountered in solvent-assisted oil recovery operations is that the injected solvent component is often flashed as it enters the production tubing (i.e. as it passes through the port or a nozzle provided therewith). Therefore, in one aspect, the presently described nozzle prevents or at least mitigates against such flashing by means of a unique internal passage profile that avoids large pressure drops as the solvent passes there-through.

For this purpose, the nozzle described herein comprises an inlet and an outlet and a flow path, or passage, there-between, the converging portion includes a constriction, comprising a region of the passage having the smallest cross-sectional area. The nozzle may also include a third section comprising a region of constant cross-sectional area proximal to the outlet.

Figure 3:
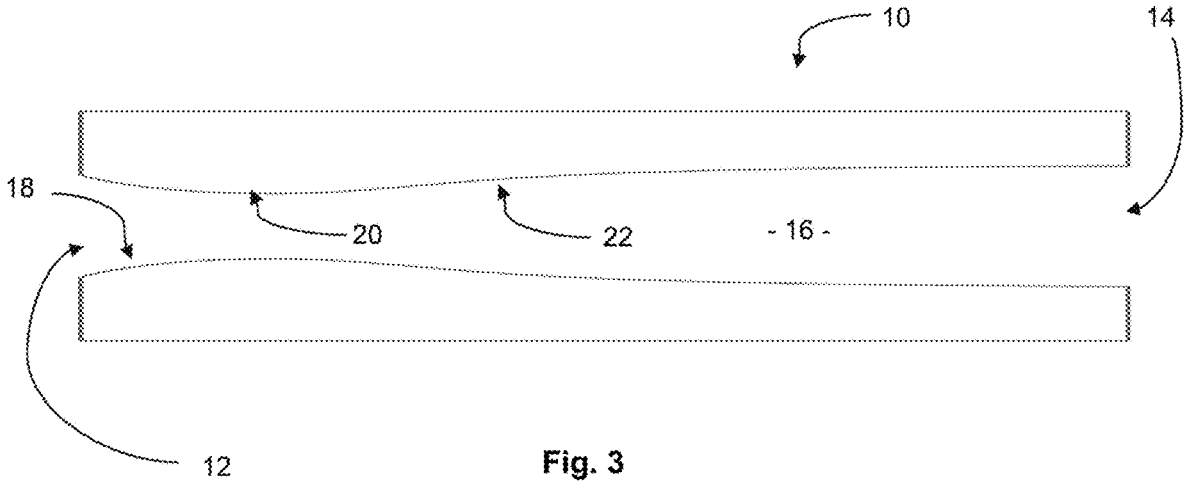
FIG. 3 is a side cross-sectional view of the nozzle according to an aspect of the present description adapted to mitigate against solvent flashing.
Figure 4:
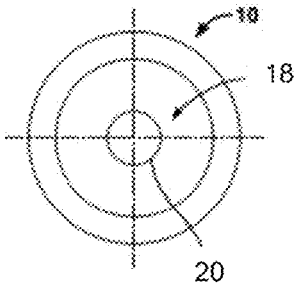
FIG. 4 is an end view of the nozzle of FIG. 3 showing the inlet thereof.
Figure 5:
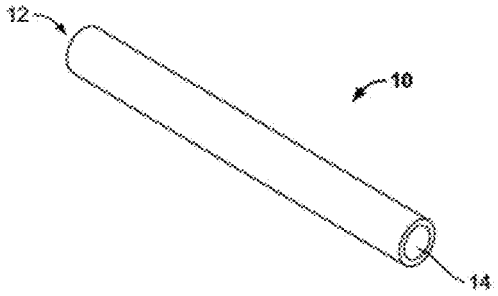
FIG. 5 is a top, perspective view of the nozzle of FIG. 3 showing the outlet thereof.

One aspect of the nozzle of the present description is illustrated in FIG. 3. As shown, the nozzle 10 comprises an inlet 12 and an outlet 14 and a flow path, or passage 16 extending between the inlet and outlet. the passage comprises a first section, or converging region 18, for receiving reservoir fluids from the inlet. The converging region has a gradually decreasing cross-sectional area. The converging region 18 terminates at a throat 20, which comprises a region of the passage 16 having the smallest (i.e. minimal) cross-sectional area. The passage 16 further includes a diverging region 22, for conveying fluids from the throat 20 to the outlet 14. As with the converging region, the diverging region 22 comprises a gradually increasing cross-sectional area, an example of which is illustrated in FIG. 3.

In one aspect, as illustrated in FIG. 3, the throat 20 of the nozzle 10 is provided proximal to the inlet 12. In another aspect, the throat may be provided with a region of constant internal diameter between the converging and diverging portions thereof. However, in a preferred aspect, the throat has no such constant diameter region. By positioning the throat closer to the inlet than the outlet and by providing the throat with a quick transition from converting to diverging diameter (i.e. essentially no constant diameter region), it will be understood that the possibility of flashing of the flowing fluid would be minimized.

The inlet 12 and outlet 14 of the nozzle 10 may have the same or different diameters.

Figure 6:
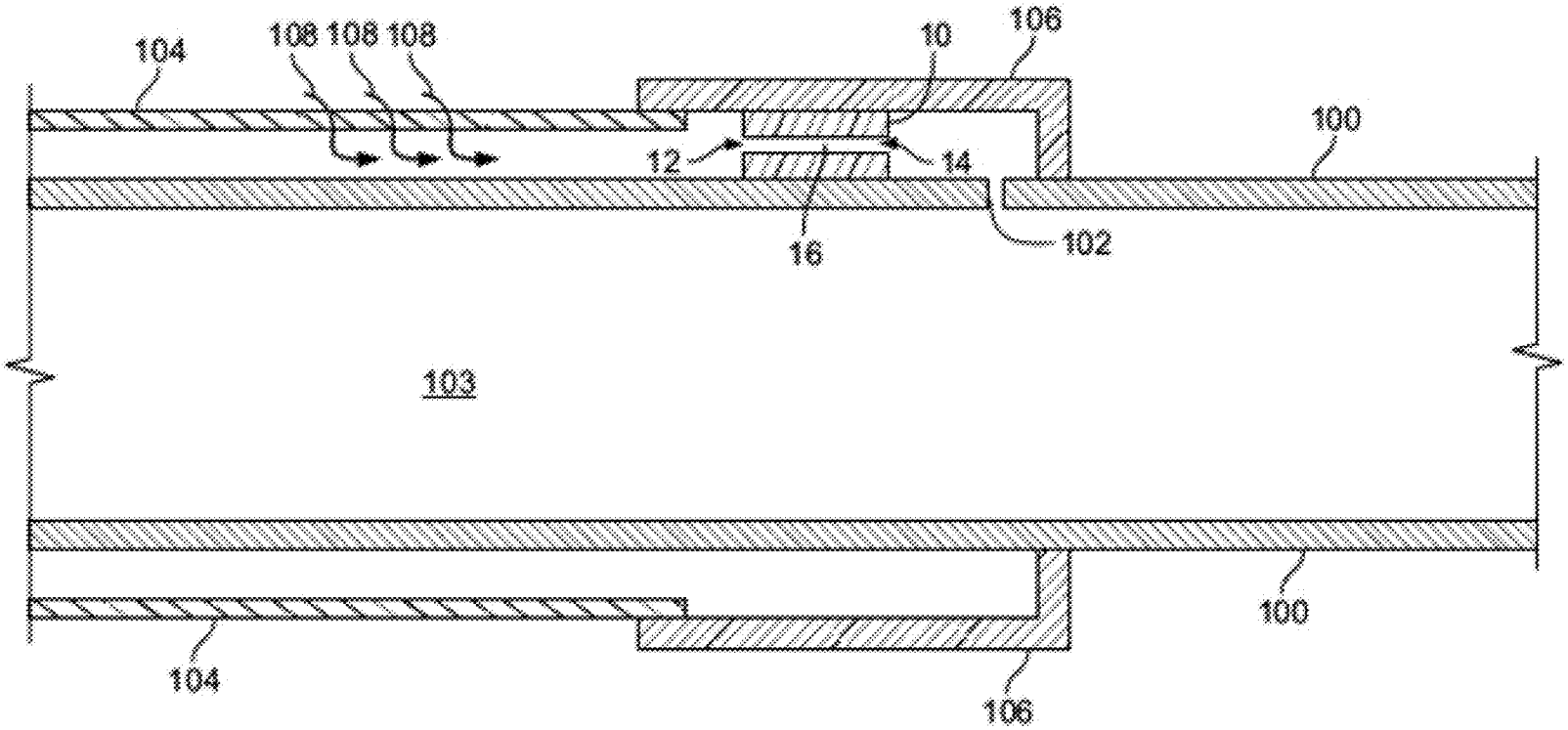
FIG. 6 is a side cross-sectional view of a flow control nozzle according to an aspect of the present description, in combination with a portion of production tubing.

FIG. 6 schematically illustrates a pipe 100 that is provided with a nozzle 10 as described herein. As shown, the pipe 100 comprises an elongate tubular body having a number of ports 102 along its length. The ports 102 allow fluid communication between the exterior of the pipe and its interior, or lumen, 103. As is common, pipes used for production (i.e. production tubing) typically include a screen 104, such as a wire-wrap screen or the like, for screening fluids entering the pipe. The screen 104 serves to prevent or filter sand or other particulate debris from the wellbore from entering the pipe. Typically, the screen 104 is provided over the surface of the pipe 100 and is retained in place by a collar 106 or any other such retaining device or mechanism. It will be understood that the present description is not limited to any type of screen 104 or screen retaining device or mechanism 106. The present description is also not limited to any number of ports 102. Furthermore, it will be appreciated that while the presence of a screen 104 is shown, the use of the presently described nozzle is not predicated upon the presence of such screen. Thus, the presently described nozzle may be used on a pipe 100 even in the absence of any screen 104. As would be understood, in cases where no screen is used, a retaining device, such as a clamp 106 or the like, will be utilized to secure nozzle 10 to the pipe 100. Alternatively, the nozzle 10 may be secured to the pipe in any other manner as would be known to persons skilled in the art.

As shown in FIG. 6, a nozzle according to the present description is shown generally at 10. It will be understood that the illustration of nozzle 10 is, for convenience, schematic and is not intended to limit the structure of the nozzle to any particular shape or structure. Thus, the nozzle 10 of FIG. 6 may consist of the nozzle described herein, including that shown in the accompanying figures, or any other nozzle configuration in accordance with the present description.

As shown in FIG. 6, the nozzle 10 is positioned on the outer surface of the pipe 100 and located proximal to the port 102. In general, the nozzle 10 is positioned in the flow path of fluids entering the port 102 so that such fluids must first pass through the nozzle before entering the port 102.

It will be understood that the nozzle 10 may be positioned over the pipe 100 in any number of ways. For example, in one aspect, the outer surface of the pipe 100 may be provided with a slot into which the nozzle 10 may be located. The nozzle 10 may be welded or otherwise affixed to the pipe 100 or retained in place with the retaining device 106 as discussed above.

In assembling the apparatus incorporating a sand screen, the pipe 100 is provided with the nozzle 10 and the screen 104 and the associated retaining device 106. The pipe 100 is then inserted into a wellbore.

During the production stage, wellbore fluids, also referred to as production fluid, as illustrated by arrows 108, pass through the screen 104 (if present) and are diverted to the nozzle 10. The production fluid enters the first opening or inlet 12 of the nozzle 10 and flows through the passage 16 as described above, finally exiting through the second opening or outlet 14, to subsequently enter into the port 102 and, thereby, into the lumen 103 of the pipe 100. The fluid is then brought to the surface using commonly known methods.

As would be understood by persons skilled in the art, the nozzles described herein are designed, in particular, to be included as part of an apparatus associated with tubing, an example of which is illustrated in FIG. 6. That is, the nozzles are adapted to be secured to tubing, at the vicinity of one or more ports provided on the tubing. The nozzles are retained in position by any means, such as by collars or the like commonly associated with sand control devices, such as wire wrap screens etc. In another aspect, the present nozzles may be located within slots or openings cut into the wall of the pipe or tubing. It will be understood that the means and method of securing of the nozzle to the pipe is not limited to the specific descriptions provided herein and that any other means or method may be used, while still retaining the functionality described herein.

Figure 7:
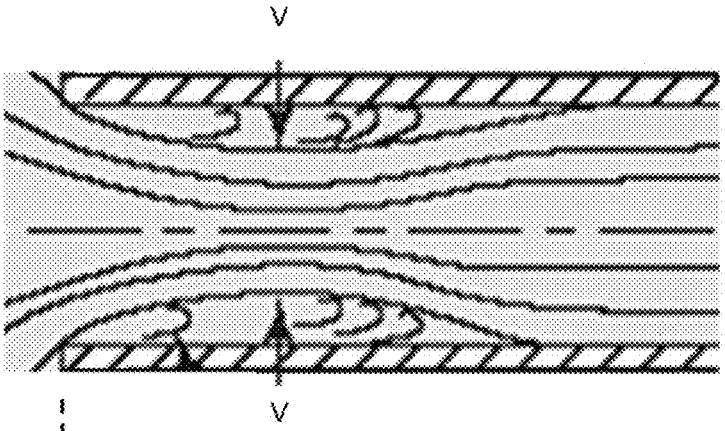
FIG. 7 is an illustration of the fluid flow through the nozzle of FIG. 1.
Figure 8:
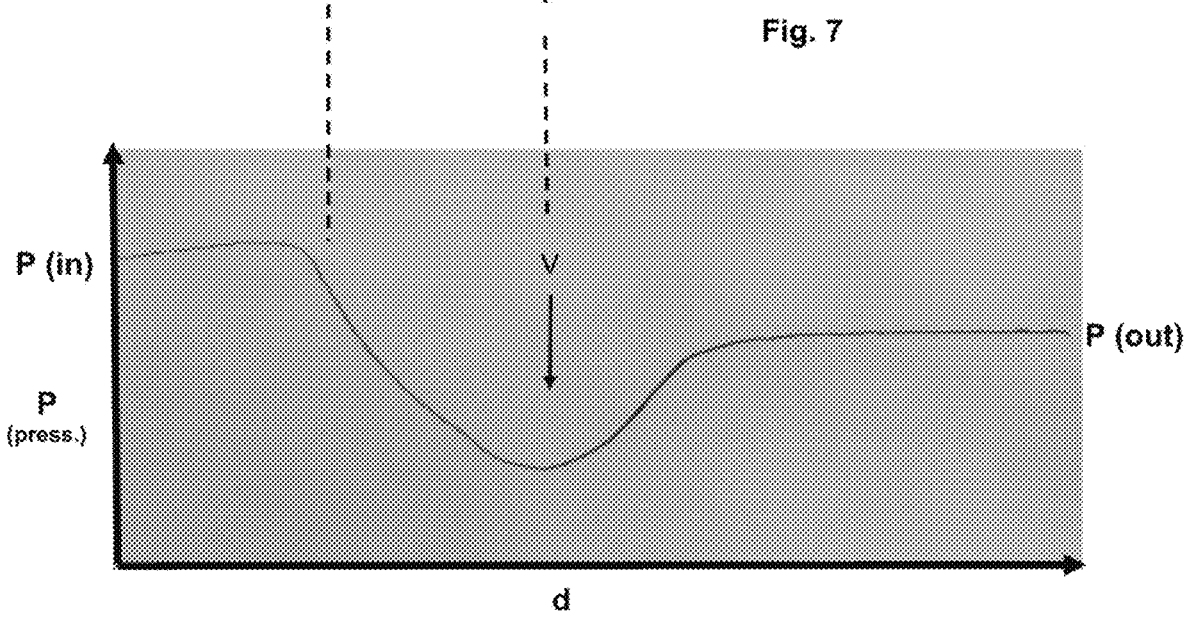
FIG. 8 is an illustration of the pressure drop experienced by fluid flowing through the nozzle of FIG. 1.

The examples provided herein serve to illustrate the advantages of the present nozzle over those illustrated in FIGS. 1 and 2 for preventing solvent flashing. FIG. 7 illustrates the flow of a fluid through the nozzle of FIG. 1 and FIG. 8 illustrates the pressure changes experienced by such fluid. As can be seen, the fluid is subjected to a drastic pressure drop as it enters the inlet of the nozzle which continues to the vena contracta, shown at V, at which point the solvent is flashed since the pressure is reduced below the solvent bubble point. The pressure at the inlet of the nozzle, P(in), is generally the reservoir pressure and the pressure at the outlet of the nozzle, P(out), is generally the pressure in the production tubing. As will be understood, P(in) will be greater than P(out). As also shown in FIG. 7, some of the initial pressure of the fluid is recovered as the fluid flows through the nozzle; however, such pressure recovery is insufficient to revert the flashed solvent back to its liquid state. In this regard, reference is made to the following mass flow equation:

$$\dot{m}=C_d\times A\times\sqrt{2\Delta P\rho}$$

In this equation, $\dot{m}$ is mass flow rate, $C_d$ is the discharge coefficient, A is the open flow area, ΔP is pressure drop, and ρ is the density of the fluid. In the situation where solvent is flashed, the average density of the flowing fluid over the entire nozzle volume will be lowered. Since the discharge coefficient, $C_d$, the throat size (i.e. open flow area, A) and pressure differential, ΔP, between inlet and outlet of the nozzle are generally constant, it will be understood that a reduction in density would result in a corresponding reduction in the mass flow rate of the liquid solvent.

Figure 9:
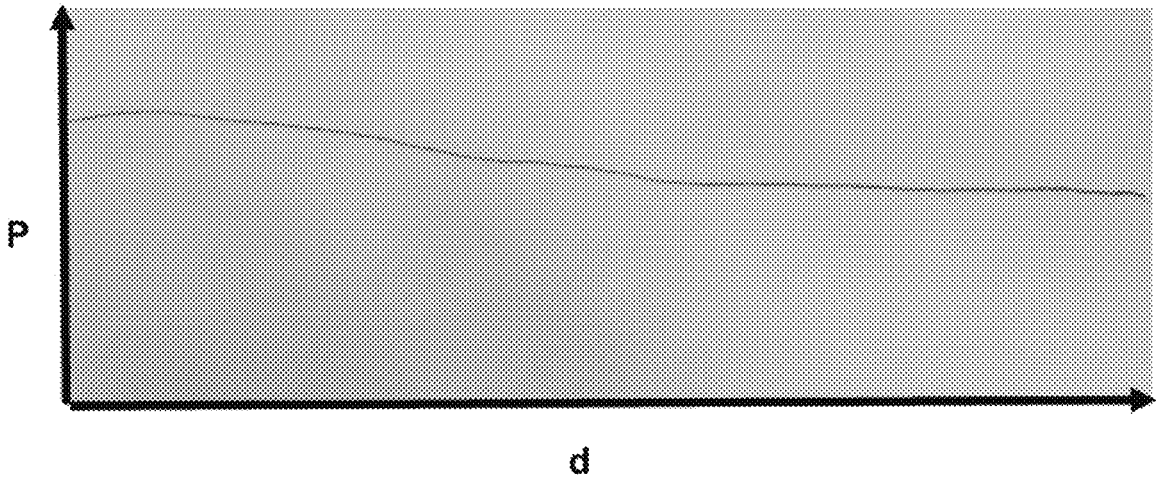
FIG. 9 is an illustration of the pressure drop experienced by fluid flowing through the nozzle of FIG. 3.

In contrast, FIG. 9 illustrates the pressure changes of a fluid flowing through a nozzle such as shown in FIG. 3 (according to an aspect of the present description). As can be seen, the fluid is not subjected to any significant pressure drop and, as such, the solvent component of the fluid generally remains in its liquid state. As will be understood, with the "smooth" geometry of the passage 16, the nozzle of FIG. 3 does not generate any eddies or other artefacts that may affect the pressure differential of the flowing fluid.

As discussed above, although the nozzle shown in FIG. 2 has certain advantages when used for gas choking, the angle of convergence in the converging region is comparatively high, i.e. roughly 30 degrees, which results in sufficient eddy formation to cause flashing of the solvent, when such nozzle is used in solvent-assisted production operations. In contrast, the nozzle of the present description is typically provided an angle of convergence that is preferably less than or equal to about 10 degrees, and more preferably less than or equal to about 5 degrees, which has been found by the inventor to avoid the flashing of solvent. In one aspect, the angle of convergence is less than about 10, 9, 8, 7, 6, 5, 4, 3, 2, 1 degrees. The diverging portion of the throat, that is, the portion of the throat facing the outlet, is provided with a similar angle of divergence. In one aspect the angle of convergence and angle of divergence are the same or similar. It will be understood that the angles of convergence and divergence are measured from a line parallel to the longitudinal axis extending through the nozzle and the wall of the converging or diverging portion of the wall of the throat. It will also be understood that such angles refer to the maximum angle of convergence or divergence.

Example

The following example summarizes a simulation that was conducted to illustrate the performance characteristics of the nozzle described herein. It will be understood that this example is only intended to illustrate the advantages of the nozzle described herein and is not intended to limit the scope of the description in any way.

In this example, the performance characteristics of the nozzles illustrated in FIGS. 1, 2 and 3 were compare. Specifically, simulations were conducted using 100% butane as the fluid. It will be understood that butane, being a very light hydrocarbon, provides a good basis for evaluating the presently described nozzles. For each of the simulations, the inlet pressure and temperature were set to 800 KPaA (absolute KPa) and 55 degrees C., respectively. These conditions were chosen to mimic the typical operating conditions and to ensure that butane was maintained in the liquid phase (the bubble point for butane at 55 deg. C. is 563 KPaA). For the simulation, the outlet pressure of the nozzles tested was maintained at 600 KPaA in order to determine if the butane would flash when the outlet pressure is close to the bubble point pressure.

Table 1 summarizes the dimensions of the nozzles used for the simulation.

TABLE 1

| Nozzle | Length (mm) | Inlet diameter (mm) | Throat Diameter (mm) | Position of Throat from Inlet | Outlet Diameter (mm) |
|---|---|---|---|---|---|
| FIG. 1 | 8 | 4 | 4 | n/a | 4 |
| FIG. 2 | 100 | 12 | 4 | 20 | 12 |
| FIG. 3 | 40 | 4 | 3.4 | 2.5 | 4 |

As indicated above, the nozzles tested were of different lengths. Although the lengths of the nozzles of FIGS. 1 and 2 (i.e. 8 mm and 100 mm, respectively) are typical, the purpose of selecting such dimensions was also to compare the present nozzle (i.e. of FIG. 3) with "best case" versions of the other two nozzles.

Figure 10:
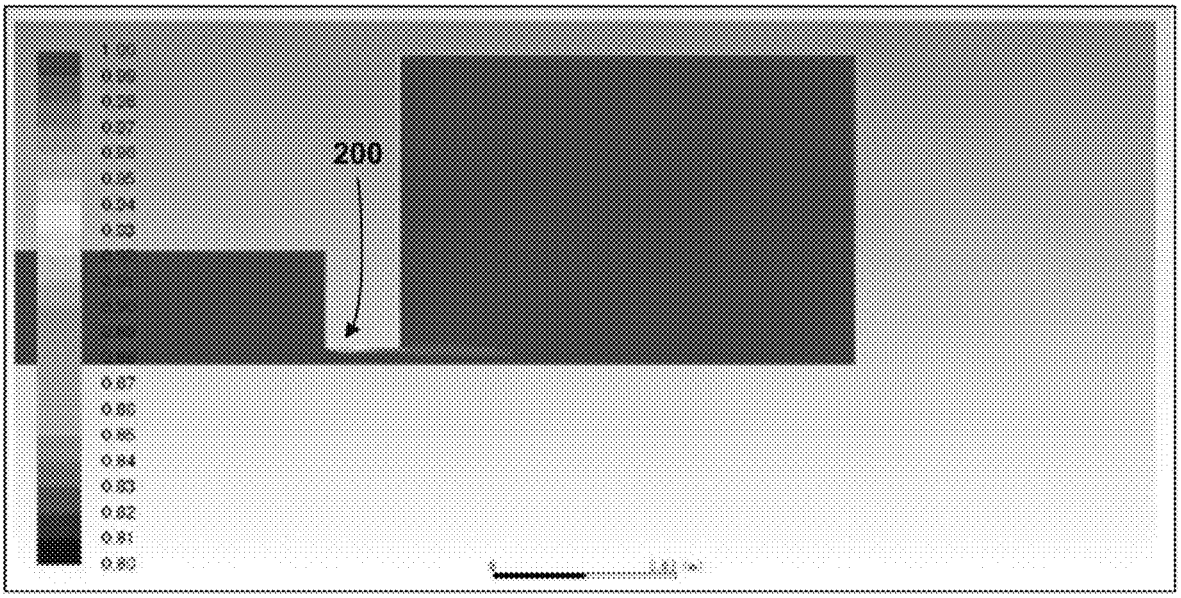
FIG. 10 illustrates the pressure drop of butane flowing through the nozzle of FIG. 1 according to the example described below.
Figure 11:
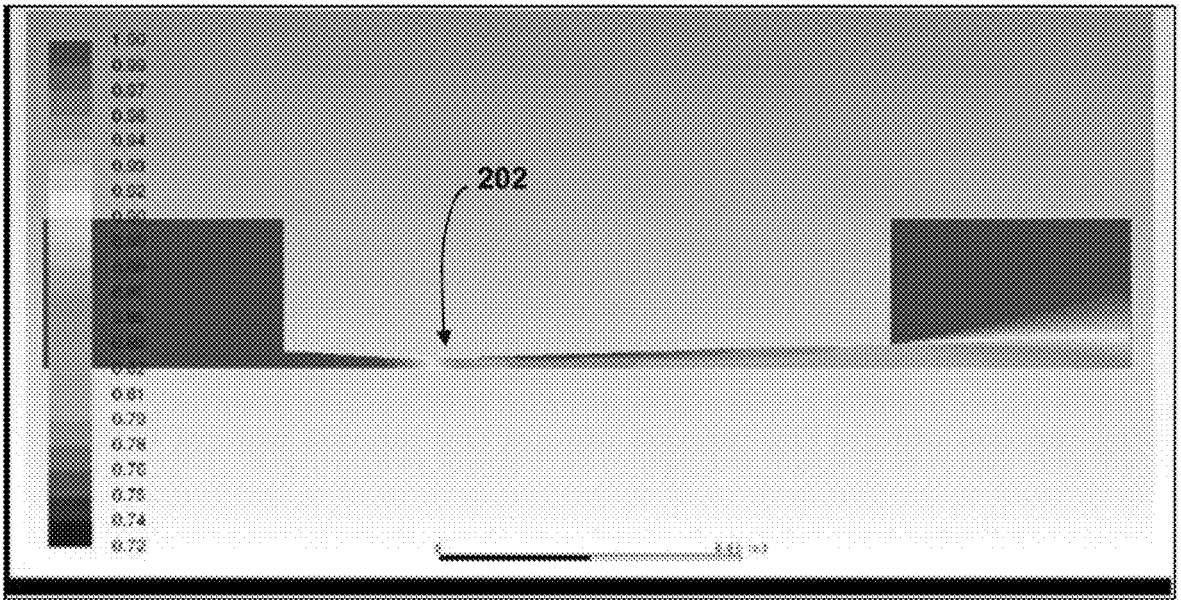
FIG. 11 illustrates the pressure drop of butane flowing through the nozzle of FIG. 2 according to the example described below.
Figure 12:
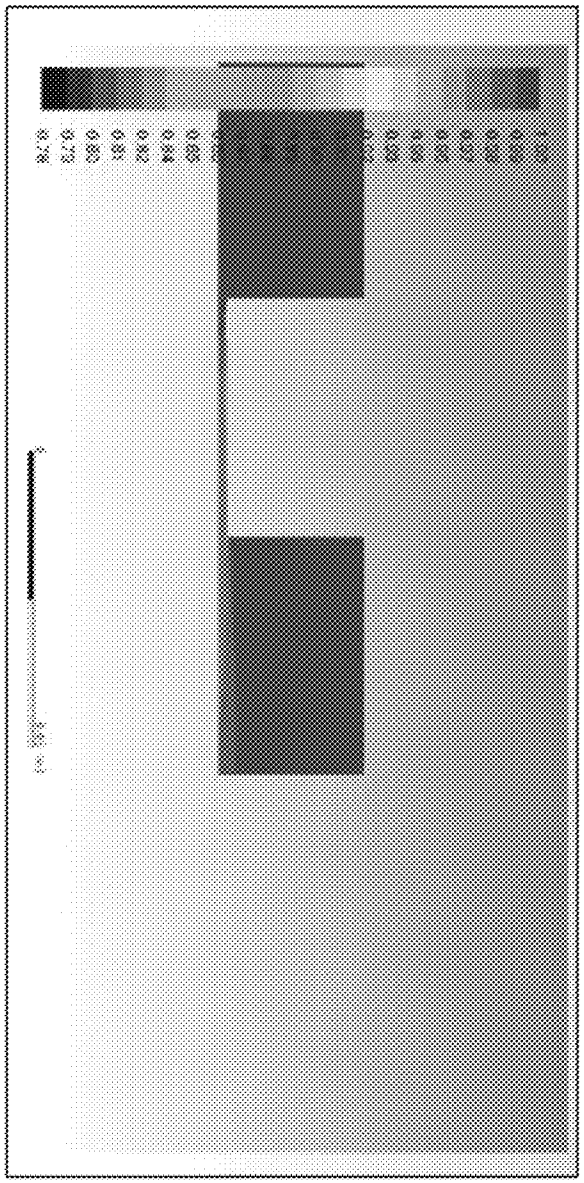
FIG. 12 illustrates the pressure drop of butane flowing through the nozzle of FIG. 3 according to the example described below.

The results from the simulations of the nozzles of FIGS. 1, 2, and 3 are illustrated in FIGS. 10, 11, and 12, respectively, which illustrate in the x-axis the position along the length of the respective nozzle, and the colour intensity illustrates liquid fraction of the butane. Thus, a fraction of 1.00 indicates that the butane is completely in the liquid state, while a fraction of 0.00 indicates that all of the butane is flashed into the gaseous or vapour state.

As shown in FIG. 10, the nozzle having the geometry shown in FIG. 1 was, as expected, found to cause localized vaporization between the inlet and the vena contracta. This is shown at 200 in FIG. 10. FIG. 11 illustrates that the nozzle having the geometry shown in FIG. 2 resulted in serious vaporization downstream of the throat, as shown at 202. In contrast, FIG. 12 shows that the nozzle having the geometry shown in FIG. 3 was found to result in virtually no flashing of the butane. The figures below show the butane liquid volume fraction contours.

The results of this example clearly show that the gradual or mild converging and diverging regions provided in the nozzle described herein meet the desired need of mitigating against solvent flashing in a solvent-assisting oil recovery operation.

Although the above description includes reference to certain specific embodiments, various modifications thereof will be apparent to those skilled in the art. Any examples provided herein are included solely for the purpose of illustration and are not intended to be limiting in any way. In particular, any specific dimensions or quantities referred to in the present description is intended only to illustrate one or more specific aspects are not intended to limit the description in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

I claim:

1. A system, comprising:

an inflow control nozzle that maintains solvent in liquid form during production of hydrocarbons into a pipe, the pipe having at least one port along its length, the nozzle being adapted to be located on the exterior of the pipe and adjacent one of the at least one port, the nozzle comprising:

a body having a first end and a second end, an inlet comprising an opening in the first end, an outlet comprising an opening in the second end, and a fluid conveying passage extended between the inlet and the outlet, the passage having a longitudinal axis extending in a direction from the inlet to the outlet, the inlet and outlet each being orthogonal to the longitudinal axis;

wherein, the passage comprises:

a converging region for receiving fluids from the inlet, the converging region comprising a gradually reducing cross-sectional area along the axis;

the converging region terminating at a throat defining a region of minimal cross-sectional area along the axis; and, a diverging region, for conveying fluids from the throat to the outlet, the diverging region comprising a gradually increasing cross-sectional area along the axis, wherein the angle of divergence of the diverging region is less than about 10 degrees with respect to the longitudinal axis.

2. The nozzle of claim 1, wherein the throat is located closer to the inlet than the outlet.

3. The nozzle of claim 1, wherein the angle of convergence of the converging region is equal to or less than about 5 degrees with respect to the longitudinal axis.

4. A method of producing fluids from a subterranean reservoir while limiting the flashing of at least one solvent present in the reservoir, the method comprising:

a) providing a system as claimed in claim 1 adjacent a port on a section of production tubing for use in producing hydrocarbons from the reservoir;

b) flowing the fluids through the converging region, through the throat, adn through the diverging region without flashing the at least one solvent.

5. The method of claim 4, wherein the angle of convergence of the converging region is equal to or less than about 10 degrees as measured from the longitudinal axis to wall of the passageway.

6. The method of claim 4, wherein the angle of convergence of the converging region is equal to or less than about 5 degrees as measured from the longitudinal axis to wall of the passageway.

7. The method of claim 4, wherein the angle of divergence of the diverging region is equal to or less than about 5 degrees as measured from the longitudinal axis to wall of the passageway.

8. A system of claim 1, wherein the angle of convergence of the converging region is equal to or less than about 10 degrees as measured from the longitudinal axis to wall of the passageway.

9. A system of claim 1, wherein the angle of divergence of the diverging region is equal to or less than about 5 degrees as measured from the longitudinal axis to wall of the passageway.

10. A system comprising:

an apparatus that maintains solvent in liquid form during production of hydrocarbons into a pipe, the apparatus comprising: a pipe segment having at least one port along its length; at least one inflow control nozzle located on the exterior of the pipe and adjacent one of the at least one port; and, a means for locating the nozzle on the pipe adjacent the port; wherein the nozzle comprises:

a body having a first end and a second end, an inlet comprising an opening in the first end, an outlet, comprising an opening in the second end, and a fluid conveying passage extending between the inlet and the outlet, the passage having a longitudinal axis extending in a direction from the inlet to the outlet, the inlet and outlet each being orthogonal to the longitudinal axis;

wherein, the passage comprises:

a converging region for receiving fluids from the inlet, the converging region comprising a gradually reducing cross-sectional area along the axis;

the converging region terminating at a throat defining a region of minimal cross-sectional area along the axis; and, a diverging region, for conveying fluids from the throat to the outlet, the diverging region comprising a gradually increasing cross-sectional area along the axis, wherein the angle of divergence of the diverging region is less than about 10 degrees with respect to the longitudinal axis.

11. A system of claim 10, wherein the angle of convergence of the converging region is equal to or less than about 10 degrees as measured from the longitudinal axis to wall of the passageway.

12. A system of claim 10, wherein the angle of convergence of the converging region is equal to or less than about 5 degrees as measured from the longitudinal axis to wall of the passageway.

13. A system of claim 10, wherein the angle of divergence of the diverging region is equal to or less than about 5 degrees as measured from the longitudinal axis to wall of the passageway.

* * * * *